US009930968B2

(12) United States Patent
Wilkinson

(10) Patent No.: US 9,930,968 B2
(45) Date of Patent: Apr. 3, 2018

(54) APPARATUS FOR LIFTING AND SUPPORTING THE LOWER LEG AND FOOT OF A PATIENT

(75) Inventor: Mike Wilkinson, Little Hampton (GB)

(73) Assignee: Genie Care Ltd., Blackwood (GB)

( * ) Notice: Subject to any disclaimer, the term of this patent is extended or adjusted under 35 U.S.C. 154(b) by 1168 days.

(21) Appl. No.: 12/452,530

(22) PCT Filed: Jul. 8, 2008

(86) PCT No.: PCT/GB2008/002333

§ 371 (c)(1),
(2), (4) Date: Mar. 8, 2010

(87) PCT Pub. No.: WO2009/007705

PCT Pub. Date: Jan. 15, 2009

(65) Prior Publication Data

US 2010/0163055 A1 Jul. 1, 2010

(30) Foreign Application Priority Data

Jul. 10, 2007 (GB) ..... 0713383.8

(51) Int. Cl.
*A61G 5/12* (2006.01)
*A47C 16/02* (2006.01)

(52) U.S. Cl.
CPC ..... *A47C 16/025* (2013.01)

(58) Field of Classification Search
CPC ..... A47C 16/025; A47C 16/02; A61G 5/12; A61G 2005/127; A61G 2005/128
USPC ..... 211/72–73, 195; 297/423.41, 423.45; 5/648–651; 128/845, 882; 602/33–35, 5, 602/20, 23, 60–62, 4; 4/571.1–579, 4/567–570
See application file for complete search history.

(56) References Cited

U.S. PATENT DOCUMENTS

| | | | | |
|---|---|---|---|---|
| 2,469,361 | A | 5/1949 | Anderson | |
| 2,584,412 | A | 2/1952 | Anderson | |
| 2,709,435 | A * | 5/1955 | Kress | 604/293 |
| 2,736,038 | A * | 2/1956 | Mansfiled | 4/622 |
| 4,336,796 | A * | 6/1982 | Andrews et al. | 602/23 |
| 5,001,739 | A * | 3/1991 | Fischer | 378/209 |
| 5,002,046 | A * | 3/1991 | Scott | 602/36 |
| 5,111,808 | A * | 5/1992 | Meals | 602/23 |
| 5,891,151 | A | 4/1999 | Rivera-Esquerdo | |
| 6,221,036 | B1 * | 4/2001 | Lucas | 602/23 |
| 6,478,380 | B2 | 11/2002 | Ehrlich | |
| 6,920,881 | B2 * | 7/2005 | Narula et al. | 128/889 |
| 2004/0204668 | A1 * | 10/2004 | Polonchek | 602/32 |
| 2006/0272893 | A1 * | 12/2006 | Foggio et al. | 182/69.1 |
| 2007/0021702 | A1 * | 1/2007 | Cotton | 602/33 |

(Continued)

FOREIGN PATENT DOCUMENTS

| | | |
|---|---|---|
| GB | 26233 | 7/1911 |
| WO | WO 2005/067859 A1 | 7/2005 |
| WO | WO2006/084393 | 8/2006 |

(Continued)

*Primary Examiner* — Kari Rodriquez
(74) *Attorney, Agent, or Firm* — Levy & Grandinetti

(57) ABSTRACT

Apparatus for lifting and supporting the lower leg and foot of a seated patient comprising a heel or an ankle support adapted to fit beneath the patient's heel or ankle, lifting means for raising said support, and in which the support is releasable from the lifting means.

20 Claims, 9 Drawing Sheets

(56) References Cited

U.S. PATENT DOCUMENTS

2010/0011941 A1* 1/2010 Becker et al. ..... 84/612

FOREIGN PATENT DOCUMENTS

WO WO2006084393 * 8/2006
WO WO 2006084393 A2 * 8/2006

* cited by examiner

APPARATUS FOR LIFTING AND SUPPORTING THE LOWER LEG AND FOOT OF A PATIENT

The Applicants claim priority to International Application Number PCT/GB2008/002333, filed on Jul. 8, 2008, which claims priority to Great Britain Application Number 0713383.8, filed on Jul. 10, 2007.

This invention relates to apparatus for lifting and supporting the lower leg and foot of a seated patient.

Nurses treating patient's ankles and lower legs often suffer from back injuries and the present invention is intended to provide apparatus which will place the patient's ankle and lower leg in a position in which it can be treated effectively by the nurse.

Thus the apparatus can be used to support the leg during the entire process of treating a wound and bandaging it with a dressing without need for the nurses to support the leg themselves.

The apparatus can also provide the facility for bathing or showering the foot and lower leg, for example prior to bandaging or dressing it.

According to the present invention apparatus for lifting and supporting the lower leg and foot of a seated patient comprises a heel or an ankle support adapted to fit beneath the patient's heel or ankle, lifting means for raising said support and in which the support is releasable from the lifting means.

Thus the heel or ankle support can be in the form of a flexible strop which extends between spaced apart arms on the lifting means.

In one preferred embodiment the flexible strop is formed by a fabric material sling which is medically suitable to be bandaged into a dressing on the patient's foot or leg.

Thus, with this arrangement the spaced apart arms are sufficiently wide apart to enable a nurse to bandage around the foot and heel without restriction and the fabric material sling can be bandaged into the dressing. Any excess material of the sling can be simply cut away once the process is complete.

According to another embodiment of the invention the flexible strop can be provided by a strap which is long enough to allow one end to be releasably attached to one arm, wrapped around the patient's ankle or leg and for the other end to be releasably secured to the other arm. This construction may prove a more secure support to the leg and helps to keep the strap closer to the leg around the sides which allows for easier bandaging.

As there is a possible risk of creating a tourniquet around the ankle which is a particular problem for patient's who usually have poor circulation in the legs, a ring of soft material, for example foam, can be provided which is adapted to be placed on the patient's ankle or leg prior to fitting the strap.

The lifting means can be pneumatically, hydraulically or electrically operated and in one preferred construction the lifting means include a first member adapted to rest on a supporting surface, a second member hinged to said first member and a third member hinged to the second member in a Z configuration, and actuating means for adjusting the angle between the first and second member and between the second and third member on which the spaced apart arms are provided.

Thus, the actuating means can be provided by inflatable elements provided between the first and second and second and third members.

The apparatus can also include a shower catch bag with a means for attachment to the lifting means and to the patient's leg thus enabling the apparatus to be used to clean the patient's leg and foot prior to treatment.

Preferably the shower catch bag is provided with a drain bag so that the apparatus can be easily dismantled and any waste fluids taken away with it.

In another alternative embodiment according to the invention the apparatus can include means for supporting the lower leg when the ankle support is released.

In this arrangement the ankle support and lower leg support means can be provided by a substantially rigid trough the distal end of which is closed by a removable ankle support and the proximal end of which is pivoted to a stand.

Preferably the stand is adjustable.

The lifting means in this construction can be located beneath the substantially rigid trough and act to support the trough when the ankle support is released.

These lifting means can be pneumatically, hydraulically or electrically operated.

In a preferred construction the lifting means are provided by one or more inflation bags.

The rigid trough can also act as a bath. The apparatus can include a removable bath liner and drain bag.

The invention can be performed in various ways and some embodiments are now described by way of example and with reference to the accompanying drawings in which.

Figure 7:
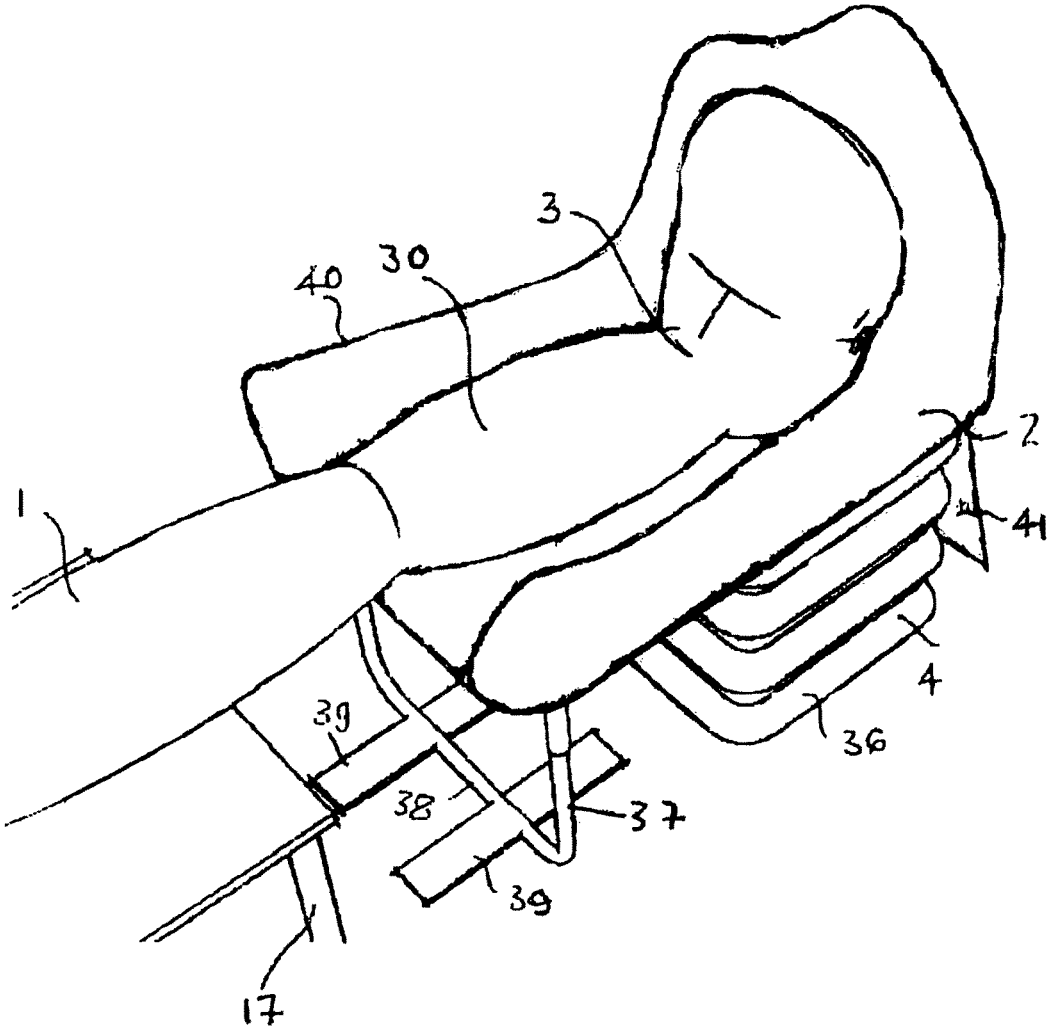
Figure 8:
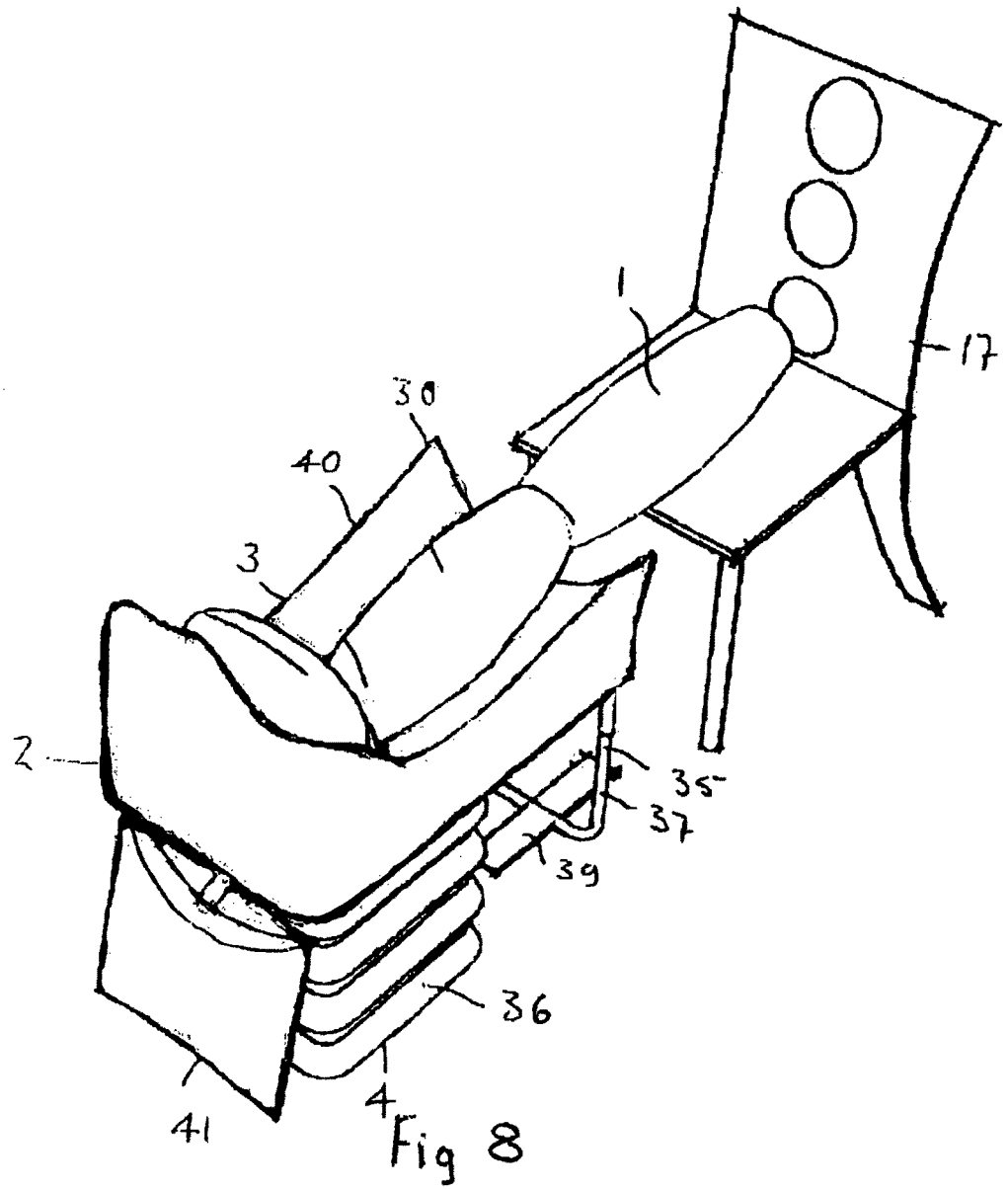
Figure 9:
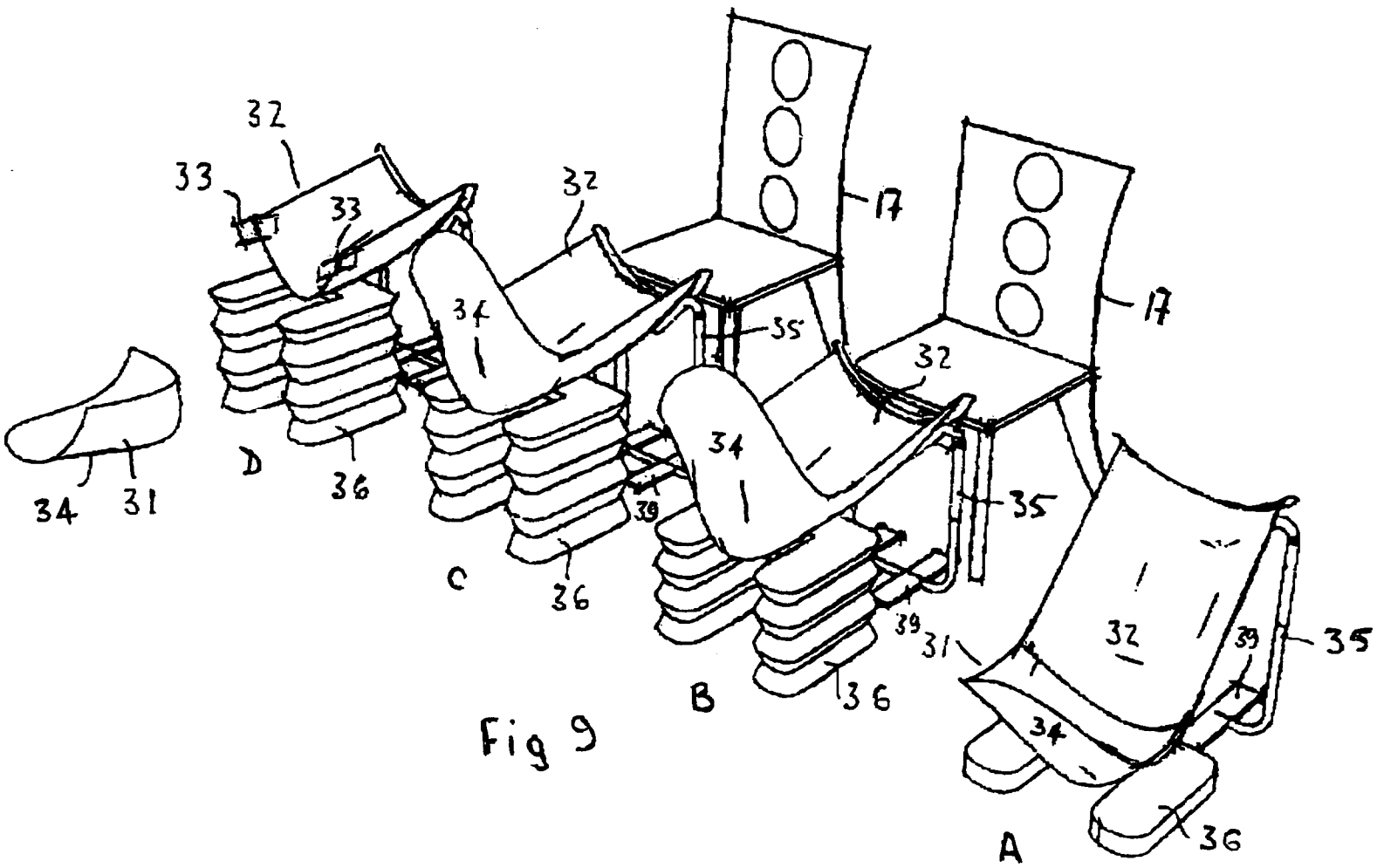

FIG. 7 in a diagrammatic isometric view from the front of the apparatus according to a further embodiment;

FIG. 8 is an isometric view from the rear of the apparatus shown in FIG. 7; and, FIG. 9 is a series of isometric views from the front showing the apparatus show in FIGS. 7 and 8 in different operative positions.

Figure 1:
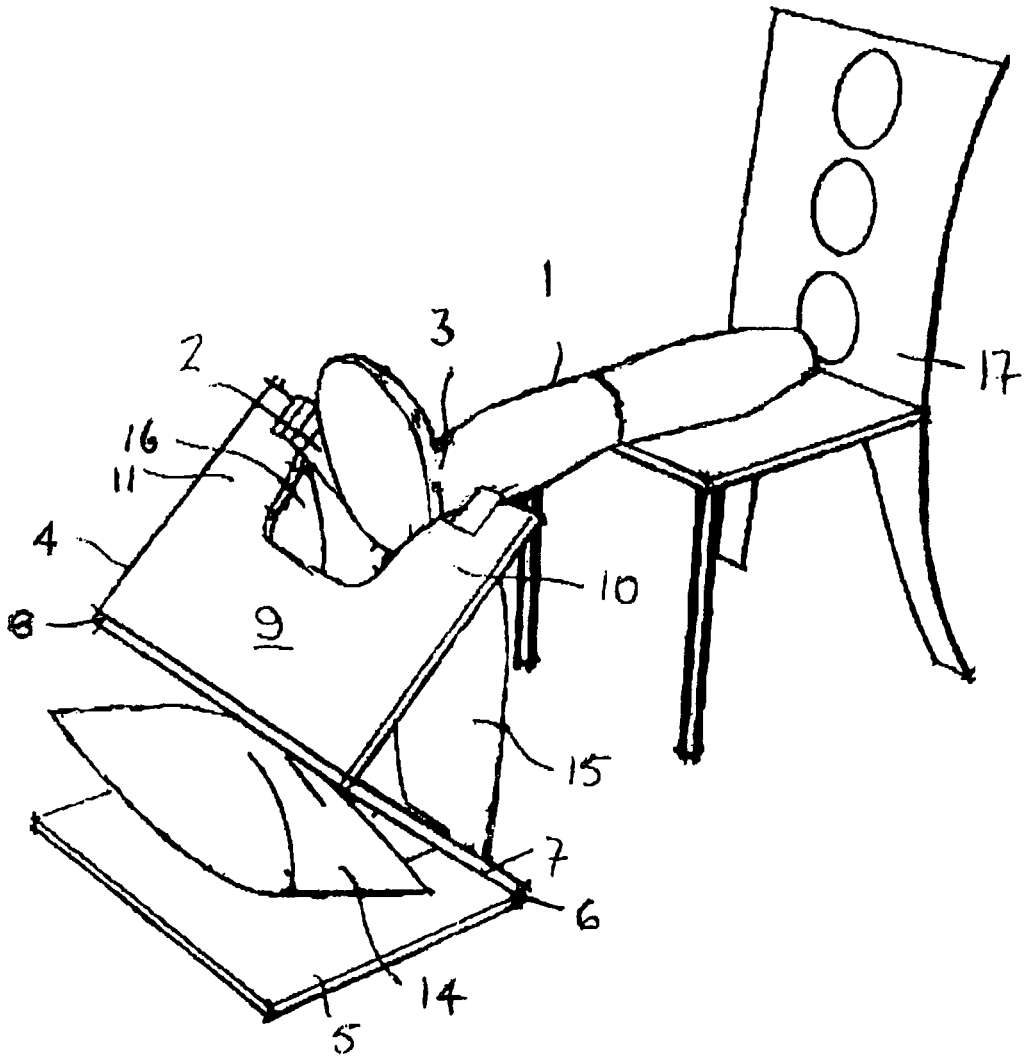
FIG. 1 is a diagrammatic isometric view from the front of apparatus according to the invention.
Figure 2:
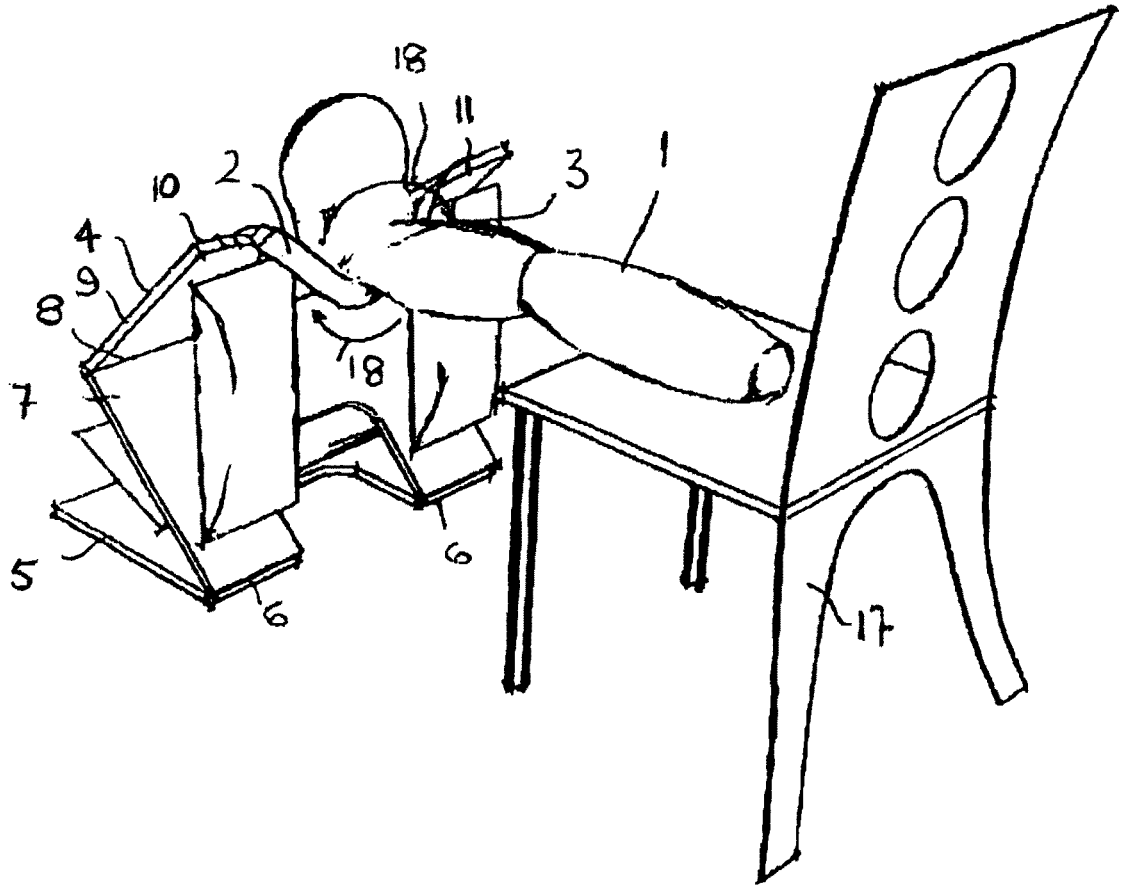
FIG. 2 is a diagrammatic isometric view from the rear of the apparatus shown in FIG. 1.

As shown in FIGS. 1 and 2 the invention comprises apparatus for lifting and supporting the lower leg and foot of a seated patient, indicated by reference numeral 1, and comprises a heel or an ankle support 2 adapted to fit beneath the patient's heel or ankle, indicated by reference numeral 3. Lifting means 4 are provided for raising the support 2 and the ankle support 2 is releasable from the lifting means 4.

In this construction the heel or ankle support 2 is in the form of a flexible strop, best seen in FIG. 2. This is formed by a fabric material sling which is medically suitable to be bandaged into a dressing on the patient's foot or leg.

The lifting means 4 includes a first plate-like member 5 which is adapted to rest on a supporting surface, for example the floor. This first member 5 is connected by spaced apart hinges 6 to a second plate-like member 7 which is in turn connected by a hinge 8 to a third plate-like member 9 in a Z configuration.

The third plate-like member 9 is shaped to provide two spaced apart arms 10 and 11 between which the flexible strip 2 extends.

The first and second members 5 and 7 can also have cut outs to provide arms of a similar shape to arms 10 and 11.

Actuating means for adjusting the angle between the first and second member and between the second and third member are provided by inflatable elements in the form of airbags 14, 15 and 16 which can be inflated to raise the ankle support and deflate it to lower it.

The apparatus can be used to raise the ankle 3 and lower leg 1 of a patient whilst seated on a suitable support, for example a chair as indicated by reference numeral 17. Operation of the apparatus therefore relieves the nurse of lifting the leg and the patients ankle or leg can be treated. The arms 10 and 11 are spaced wide enough apart to enable a nurse to bandage around the foot and heel without restriction. To support the leg a clinically clean cotton sling is used beneath the patient's heel and this is intended to be bandaged into the dressing and any excess material will simply be cut away once the process is completed.

The ends of the material sling 2 can be releasably attached to the arms 10 and 11 by any convenient means, for example by use of a hook and loop material or simple hooks or catches.

The direction of bandaging of the ankle is indicated by arrows 18 in FIG. 2.

Figure 3:
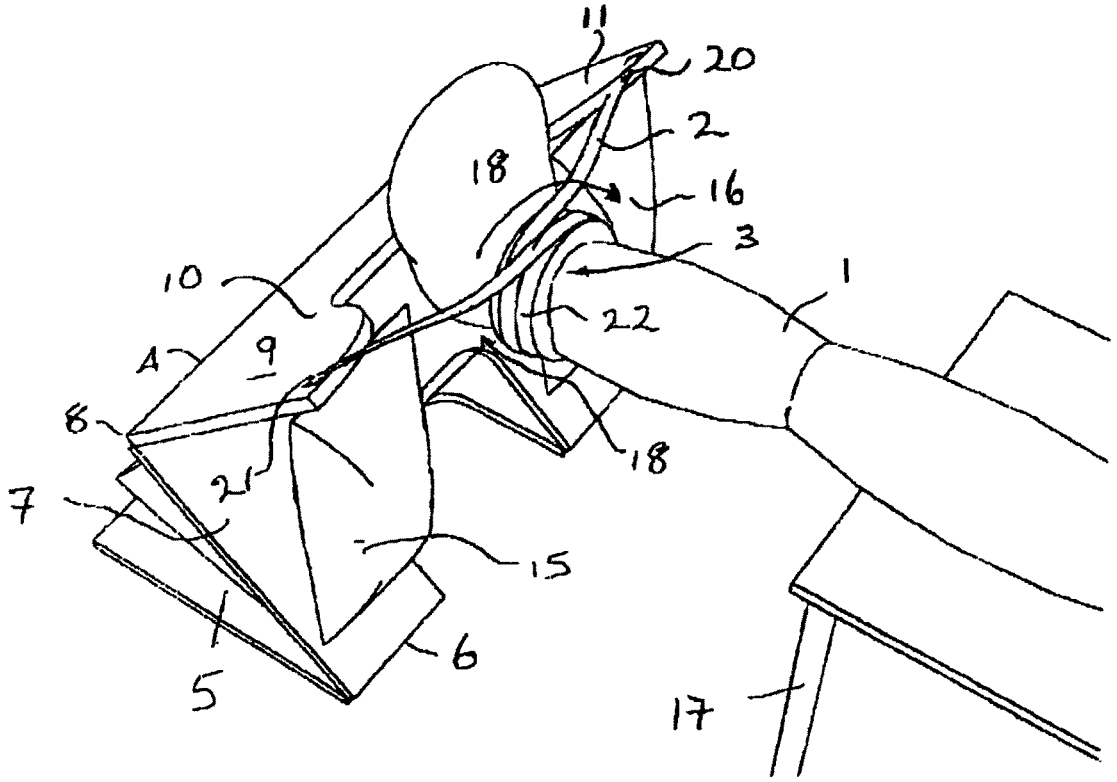
FIG. 3 is a diagrammatic isometric view from above and rear of an alternative construction according to the invention.

FIG. 3 shows an alternative construction in which the same reference numerals are used to indicate similar parts as in FIGS. 1 and 2. With this arrangement the flexible strop 2 is provided by a strap which is long enough to allow one end 20 to be releasably attached to the arm 11, to be wrapped around the patient's ankle or leg and for the other end 21 to be releasably secured to the arm 10.

This method of securing the ankle may provide a more secure support for the leg and help to keep the strap closer to the leg around the sides which will allow or easier bandaging In order to reduce the risk of creating a tourniquet around the ankle, a ring of foam material 22 is placed around the ankle before the strap is applied.

Once again the strap and the ring 22 can be bandaged into the dressing, the direction of bandage winding being indicated by arrow 18.

Figure 4:
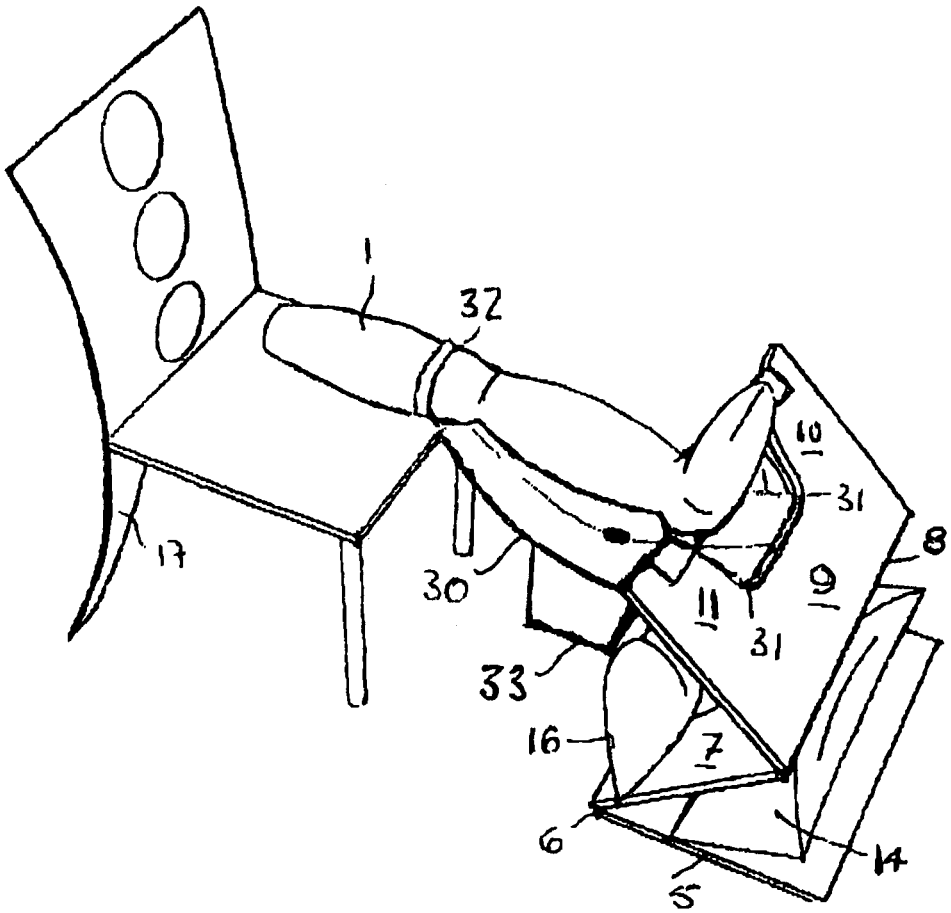
FIG. 4 is an isometric view from above and from one side of the apparatus shown in FIGS. 1 and 2 incorporating a shower catch bag.

As shown in FIG. 4 in which the same reference numerals are again used to indicate similar parts, as shown in FIGS. 1 and 2, the apparatus incorporates a shower catch bag. This is in the form of a flexible material sheet the front corners 31 of which are releasably attached to the inner ends of the arms 10 and 11 and the other end of which is secured to the patient's leg 1 by a Velcro® strap 32. The catch bag is shaped so that it assumes a curved hollow position, as shown in FIG. 4.

A drain bag 33 is also provided to catch the liquid used for washing or treating the patient's leg.

The catch bag, waste fluid and drain bag are all intended to be disposed of after treatment.

Figure 5:
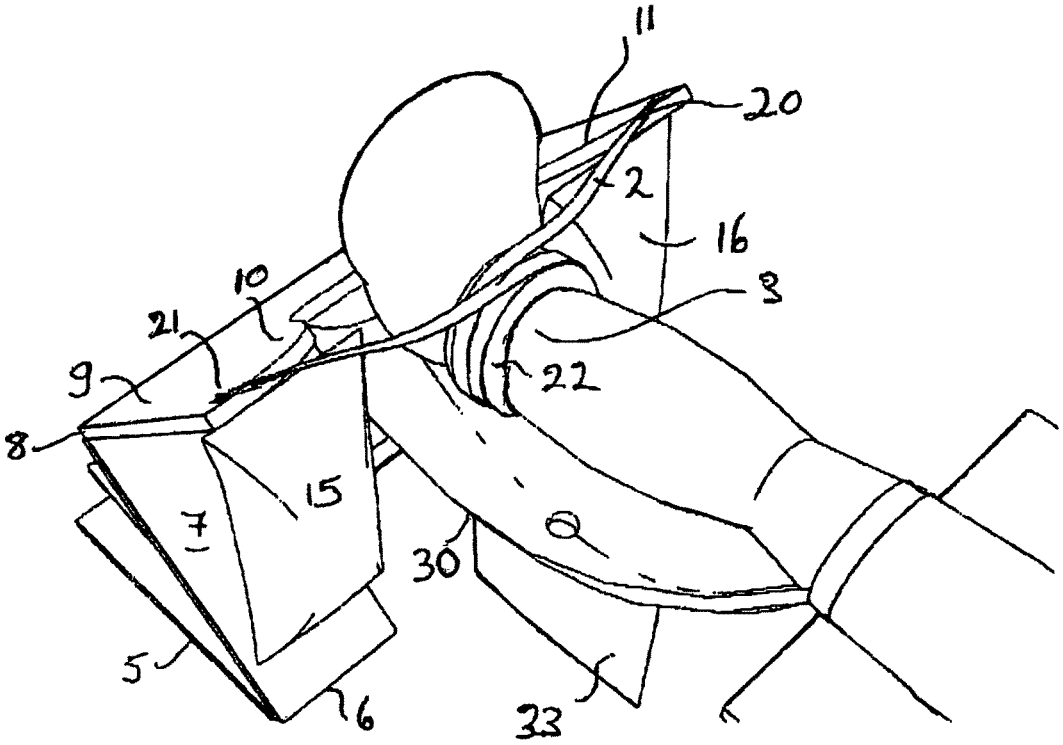
FIG. 5 is an isometric view from above of the apparatus shown in FIG. 3 incorporating a shower catch bag.

FIG. 5 shows the catch bag 30 in use with the apparatus shown in FIG. 3.

Figure 6:
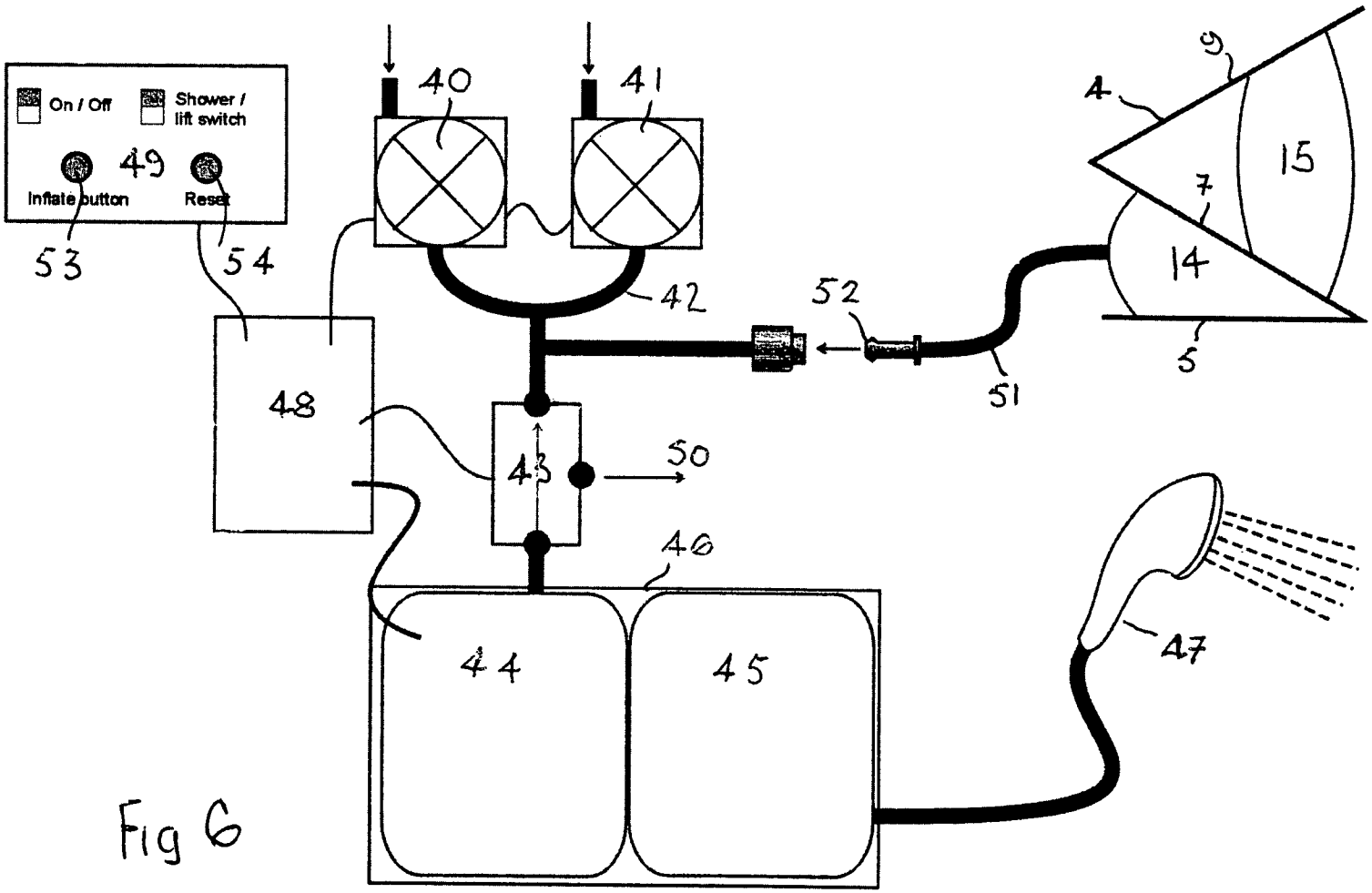
FIG. 6 is a diagram showing the layout of a combined shower unit and leg lift air supply system.

FIG. 6 shows a system for providing air pressure which can be used to operate a shower or to inflate the airbags 14, 15 and 16. The apparatus includes a pair of mini air compressors 40, 41 which can deliver an air supply to a control valve 43 through appropriate piping 42. The pressure from the compressors is delivered to an air bag 44 which bears against a dispensing bag 45 in a casing 46 from which liquid is delivered to a shower hand set 47. Thus the shower unit is operated using the inflatable air bag 44 to dispense fluid from the discrete bag 45 to the hand set 47. This arrangement allows a wide variety of fluids to be dispensed without the risk of causing damage to a pump, for example potassium permanganate is often used to clean leg ulcers due to its disinfectant properties, however when dry it forms crystals (which would be detrimental to most fluid pumps). Furthermore, the dispensing bag is replaceable and is intended for use on a per/patient basis, reducing the risk of cross-contamination between clients.

A control system, indicated by reference numeral 48, incorporates a single pressure sensor connected to the air bag 44. This is in turn linked to a switching current that will stop the pumps 40, 41 once a set pressure is reached. The pumps 40, 41 will re-start if the pressure falls below this value, thus allowing to maintain pressure, The invention will provide an even flow rate out of the shower hand set 47. If required a potentiometer can be used on a user interface 49 to provide adjustment to this pressure. This gives the user control over the dispensing speed (as higher pressure≡higher flow rate but shorter shower duration).

This system also provides an air feed to the air bags 14, 15, 16 in the lifting means 4. The control panel 49 includes a mode switch. When set to 'lift' mode the system will actuate the valve 43 and this will close off the air line 42 to the dispensing system which includes the air bag 44 and vent this airbag to atmosphere as indicated by arrow 50 allowing users to access the dispensing bag 45 and change (re-fill) this bag. In this mode the control circuit 48 is also disabled.

The lifting means 4 is now connected by air line 51 to a quick coupler connection 52 to the air line 42 and the user can then use the pumps 40, 41 to inflate the lift bags 14, 15, 16 by holding an inflate button 53 on the control panel 49. The user pushes down the button 53 until the lift has reached the required height for the particular patient. Once in this position, the user can switch the system back to shower mode and perform bathing/bandaging as required. The bag and the lift system will include non-return valves so that they will hold pressure when inflated and no further air feed is required to the lift bags.

To revert to the shower mode a reset button 54 is used on the control panel 49 and the switching system will allow use of the air bag 44 and dispensing bag 45. Prior to this the coupling 52 is disconnected.

To deflate the air bags 14, 15, 16 a release valve (not shown) is provided in each bag.

Although a combined system is described above any convenient air pressure system could be used to inflate the air bags 14, 15, 16, for example a foot pump or any kind of pressure supply.

Again, in the arrangement described above a pneumatic system is employed but if desired the air bags could be replaced by hydraulic rams which can again be operated by any convenient power source or manual form of operation, for example by a foot pump.

FIGS. 7, 8 and 9 show another alternative construction according to the invention and the same reference numerals are used to indicate similar parts as in FIGS. 1 to 6.

In this construction means are provided for supporting the lower leg of the patient indicated by reference numeral 30. The heel or ankle support 31 and means for supporting the lower leg 32 are provided by a substantially rigid trough (best shown in FIG. 9) made from any suitable material, for example a synthetic plastics material. The heel or ankle support 31 is removably attached to the trough by clips 33 so that its outer forward end 34 extends upwardly. Thus the distal end of the trough is closed by the removable heel or ankle support 31 and the proximal end is pivoted to a stand 35 by appropriate pivots (not shown). The height of the stand 35 is adjustable and lifting means 36 are located beneath the trough and can be used to raise or lower it and which will continue to support the trough when the heel or ankle support 31 is released. In FIG. 9 a first position of the apparatus is indicated by reference numeral A, a second partly raised position is shown at reference numeral B, a fully raised position at reference numeral C and at reference numeral D the trough is shown in the fully raised position with the heel or ankle support 31 removed.

The lifting means are provided by a pneumatically inflatable shaped airbag. In position A the apparatus is shown ready for use, at position B the frame 5 has been adjusted to suit the support means for the patient, for example a chair or bed and the air bag has been inflated to raise the trough. At position C the trough has been raised higher to suit a higher chair and at position D the heel or ankle support 31 has been removed to enable the patient's foot to be bandaged or treated.

If desired one or more inflation bags could be used simultaneously.

As will be seen from the drawings the frame 35 comprises a pair of upright arms 37 carried by a cross-member 38 which is provided with feet 39 to located it on a supporting surface, for example a floor. The feet 39 will prevent the frame from rocking when the airbag 36 is inflated. The air bag in this construction is of a C-shape which enables it to locate beneath the trough.

When the heel or ankle support 31 is removed the lower part 30 of the patient's leg continues to be supported by the trough 32.

It will be noted that the lift bag only takes the weight of the leg, the stand providing support for maintaining stability.

The trough and ankle support 31 can be covered by a plastics material bath liner 40 provided with a drain bag 41.

As referred to above the stand 35 is adjustable to a number of different heights which will allow for different seating heights depending upon where the patient is sitting.

In use the bath liner 40 is first fitted to the trough and the patient's leg, heel or ankle can be suitably washed and treated.

To allow the apparatus to be used with the initial stage of pressure bandaging, the heel or ankle support 31 is detached as shown at D and this allows the nurse/carer access to the patient's foot and heel whilst the leg is supported by the trough 32. Once the pressure bandaging has been started, the nurse/carer can then take the weight of the patient's leg on their knee, lower the inflation bag and removed the bath and stand. They then have full access to the patient's leg and can complete the bandaging process. This means that the nurse/carer does not have to lift the leg, and helps them to perform the most difficult part of the bandaging process.

The bath liner 40 and drain bag 41 are removed at the same time as the heel or ankle support 31 is released by sliding the bath liner out from under the patient's leg for disposal.

Operation of the air bag 36 and a system for providing air pressure which could be used to operate a shower or to inflate the airbag can be similar to that described with regard to the construction shown in FIGS. 1 to 6.

As in the other constructions although a pneumatic system is employed this could be replaced by hydraulic rams or an electrical lift system.

The invention claimed is:

1. Apparatus for lifting and supporting a lower leg and foot of a seated patient comprising:

a pneumatically, hydraulically, or electrically operated lift for raising said lower leg;

a pair of spaced arms on said lift; and a heel or ankle support in the form of a flexible sling, adapted to fit beneath the patient's heel or ankle, said sling extending between said spaced arms on the lift and being releasably attached thereto the flexible sling is a fabric material sling which is medically suitable to be bandaged into a dressing on the patient's foot or leg.

2. Apparatus as claimed in claim 1 in which the flexible sling is long enough to allow one end to be releasably attached to one arm, and wrapped around the patient's ankle or leg and for the other end to be releasably secured to the other arm.

3. Apparatus as claimed in claim 2 including a ring of soft material which is adapted to be placed on the patient's ankle or leg prior to fitting the sling.

4. Apparatus as claimed in claim 3 in which the sling and the ring of soft material are made from medically suitable material which can be bandaged into a dressing on the patient's foot or leg.

5. Apparatus as claimed in claim 1 in which the lift includes a first member adapted to rest on a supporting surface, a second member hinged to said first member and a third member hinged to the second member in a Z configuration, and an actuator for adjusting the angle between the first member and second member, and between the second member and third member on which the spaced apart arms are provided.

6. Apparatus as claimed in claim 5 in which the actuator is provided by inflatable elements provided between the first and second and second and third members.

7. Apparatus as claimed in claim 6 in which the inflatable elements comprise inflation bags.

8. Apparatus as claimed in claim 1 including a shower catch bag attachable to the lift and to the patient's leg.

9. Apparatus as claimed in claim 8 in which said shower catch bag is provided with a drain bag.

10. Apparatus for lifting and supporting a lower leg and foot of a seated patient comprising:

a pneumatically, hydraulically, or electrically operated lift for raising said lower leg; said lift including a first member adapted to rest on a supporting surface, a second member hinged to said first member, and a third member hinged to the second member to form a Z-configuration with said first and second members, and an actuator for adjusting the angle between the first and second members and between the second and third members;

a pair of spaced apart arms on said third member; and a heel or ankle support in the form of a flexible sling, adapted to fit beneath the patient's heel or ankle, said sling extending between said spaced arms on the lift and being releasably attached thereto, the flexible sling is long enough to allow one end to be releasably attached to one arm, and wrapped around the patient's ankle or leg and for the other end to be releasably secured to the other arm.

11. Apparatus as claimed in claim 10, in which the actuator is provided by inflatable elements positioned between the first and second members and between the second and third members.

12. Apparatus as claimed in claim 11 in which the inflatable elements comprise inflation bags.

13. Apparatus for lifting and supporting a lower leg and foot of a seated patient comprising:

a pneumatically, hydraulically, or electrically operated lift for raising said lower leg;

a pair of spaced arms on said lift; and a heel or ankle support in the form of a flexible sling, adapted to fit beneath the patient's heel or ankle, said sling extending between said spaced arms on the lift and being releasably attached thereto, the flexible sling is long enough to allow one end to be releasably attached to one arm, and wrapped around the patient's ankle or leg and for the other end to be releasably secured to the other arm.

14. Apparatus as claimed in claim 13 including a ring of soft material which is adapted to be placed on the patient's ankle or leg prior to fitting the sling.

15. Apparatus as claimed in claim 14 in which the sling and the ring of soft material are made from medically suitable material which can be bandaged into a dressing on the patient's foot or leg.

16. Apparatus as claimed in claim 13 in which the lift includes a first member adapted to rest on a supporting surface, a second member hinged to said first member and a third member hinged to the second member in a Z configuration, and an actuator for adjusting the angle between the first member and second member, and between the second member and third member on which the spaced apart arms are provided.

17. Apparatus as claimed in claim 16 in which the actuator is provided by inflatable elements provided between the first and second and second and third members.

18. Apparatus as claimed in claim 17 in which the inflatable elements comprise inflation bags.

19. Apparatus as claimed in claim 13 including a shower catch bag attachable to the lift and to the patient's leg.

20. Apparatus as claimed in claim 19 in which said shower catch bag is provided with a drain bag.

* * * * *